US006238064B1

(12) United States Patent
Caferro

(10) Patent No.: US 6,238,064 B1
(45) Date of Patent: May 29, 2001

(54) DECORATIVE LIGHTING LOUVER ELEMENT

(76) Inventor: Ronald N. Caferro, E. 9919 Montgomery, Spokane, WA (US) 99206

( * ) Notice: Subject to any disclaimer, the term of this patent is extended or adjusted under 35 U.S.C. 154(b) by 0 days.

(21) Appl. No.: 09/457,111

(22) Filed: Dec. 7, 1999

(51) Int. Cl.[7] ..... F21V 11/06
(52) U.S. Cl. ..... 362/290; 362/342; 362/354
(58) Field of Search ..... 362/290, 325, 362/326, 342, 352, 353, 354, 291, 292, 330

(56) References Cited

U.S. PATENT DOCUMENTS 4,268,897 * 5/1981 Schierwagen et al. ..... 362/325
4,314,320 * 2/1982 Wolar ..... 362/342
5,008,791 * 4/1991 Caffero ..... 362/290

* cited by examiner

*Primary Examiner*—Stephen Husar
*Assistant Examiner*—John Anthony Ward
(74) *Attorney, Agent, or Firm*—Wells, St. John, Roberts, Gregory & Matkin, P.S.

(57) ABSTRACT

A decorative lighting louver element is described in which a louver body includes opposed side surfaces. The louver body further includes a top end and a bottom end. A decorative member is sandwiched between the opposed surfaces and includes an edge that is visually exposed adjacent the bottom end of the louver body.

20 Claims, 11 Drawing Sheets

DECORATIVE LIGHTING LOUVER ELEMENT

TECHNICAL FIELD

The present invention relates in general to lighting louvers and more particularly to decorative lighting louver elements.

BACKGROUND OF THE INVENTION

Parabolic lighting louvers have gained wide acceptance in the lighting industry. They are typically formed of a specular material, often formed sheets of specular aluminum, with opposed parabolic side surfaces. These surfaces are joined at bottom ends by an integral bend that visually forms a dark line when viewed from below. While the bottom ends are usually not objectionable, they do represent a stark contrast with the brightly reflective specular surfaces above.

It is typical that several lighting louver elements be arranged in a geometric intersecting array, or in parallel orientations where the dark lines defined by the bottom louver body ends become very visually apparent. Again this is not typically objectionable. However, the louvers do become fairly commonplace and though quite functional, do not add significantly to a room decor. There are simply very few options for the decorator or designer to select.

It is also typical that the bottom ends of lighting louver elements are straight. Again this has not in the past been a problem, but the routine flat configurations become quite routine and uninteresting.

A need has therefor developed for more of a decorative, interesting presentation for lighting louvers while at the same time, not distracting from illumination characteristics of existing louver configurations.

The present invention provides a solution to such need by presenting a lighting louver element that has a variety of design options differing significantly from the typical specular parabolic louver configurations.

The above and further objectives and advantages of the present invention will become apparent from the following description which, taken with the appended drawings and claims, describe the best mode presently contemplated by the inventor for carrying out the invention.

BRIEF DESCRIPTION OF THE DRAWINGS

Preferred embodiments of the invention are described below with reference to the following accompanying drawings.

FIG. 4 is an exploded perspective view showing a fragment of the embodiment shown in FIGS. 1–3;

FIGS. 8–10 are illustrations exemplifying various configurations that the present element may take.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 11:
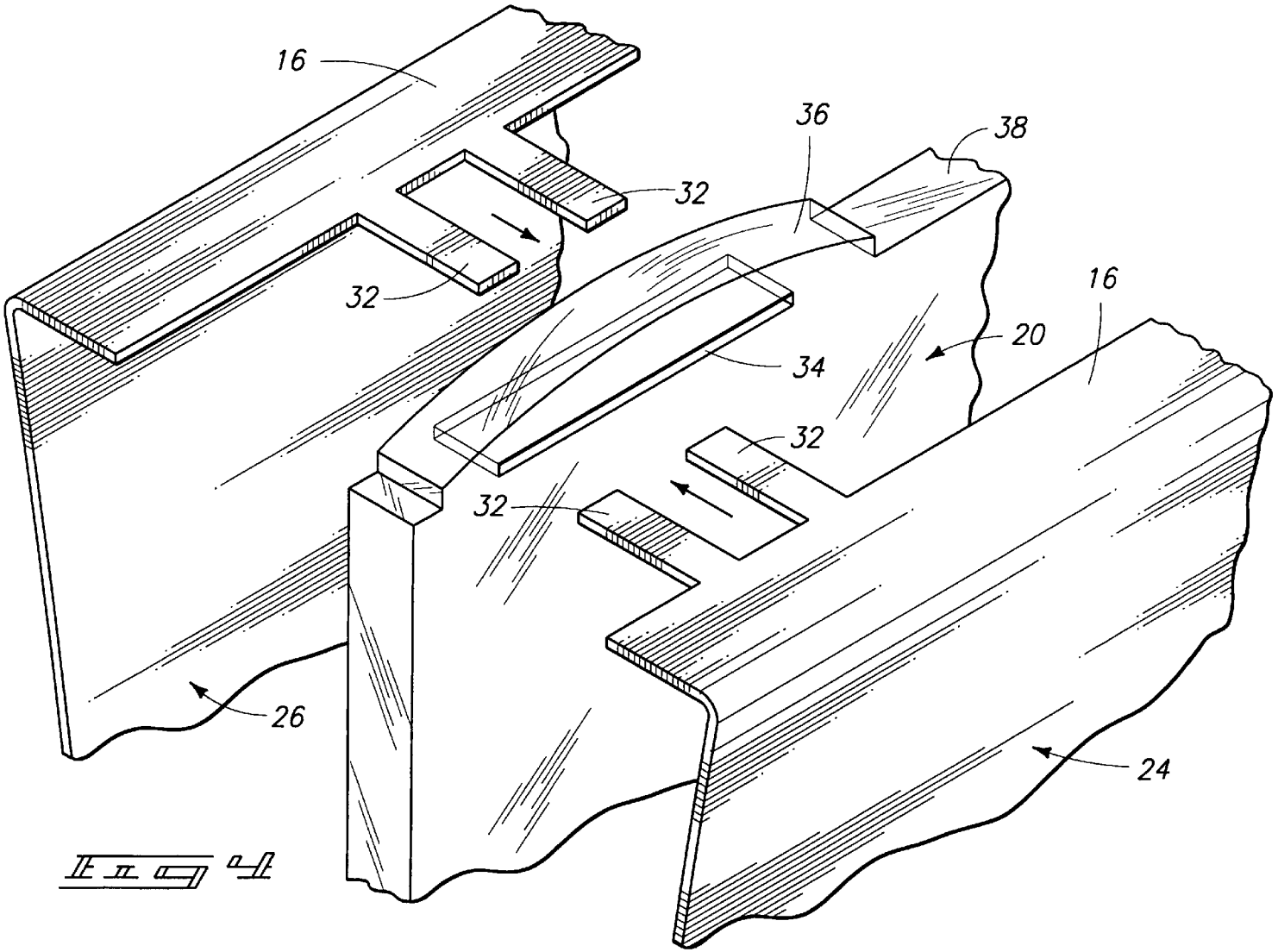
FIG. 11 is a perspective view of a typical prior art lighting louver element.

In order to gain a better understanding of the present invention, a brief description will be made of an existing, conventional parabolic lighting louver P as shown generally in FIG. 11 of the drawings. The louver P is typically constructed of a single sheet of specular aluminum, and is formed to the parabolic configuration illustrated. Parabolic side surfaces S of the louver P converge from the top end T of the louver to a bottom edge E. The integral bottom edge E is the area referred to in the "Background of the Invention" section of this document, and is intended to be eliminated in the present decorative louver 10.

In one general aspect, the present invention is embodied in a decorative lighting louver element 10 that is comprised of a louver body 12 having opposed side surfaces 14. The louver body further includes a top end 16 and a bottom end 18. A decorative member 20 is sandwiched between the opposed side surfaces 14 and includes an edge 22 that is visually exposed adjacent the bottom end 18 of the louver body 12.

In another aspect, the louver element 10 is comprised of a louver body 12 formed of opposed sheets 24, 26, each having an outwardly facing surface 14. The louver body 12 further including a top end 16 where the opposed sheets 24, 26 are joined together and a bottom end 18. A decorative member 20 is sandwiched between the opposed sheets 24, 26 and includes an bottom member edge 22 that is visually exposed adjacent the bottom end 18 of the louver body.

In a further aspect, the louver element 10 is embodied in a louver body 12 having an opposed outwardly facing specular parabolic surfaces 25, 27 respectively. The louver body 12 further includes a top end 16 and a bottom end 18 that is defined by bottom edges 28, 30 of the specular parabolic surfaces 25, 27. A decorative member 20 is sandwiched between and is visually exposed between the opposed specular parabolic surfaces 25, 27 adjacent the bottom edges 28, 30.

It is noted that preferred louver body embodiments of the present louver element 10 will be constructed of specular aluminum, using conventional forming techniques and equipment. However, other materials such as appropriate heat resistant plastics might also be used without departing from the scope of my invention. In instances where plastics are used, for example, the louver body might be opaque, transparent, or partially opaque and partially transparent. Production equipment and techniques may include but not be limited to extrusion, injection molding, or thermoforming processes. Further, a combination of materials (such as plastic and aluminum) may be used in construction of the present louver body.

Figure 7:
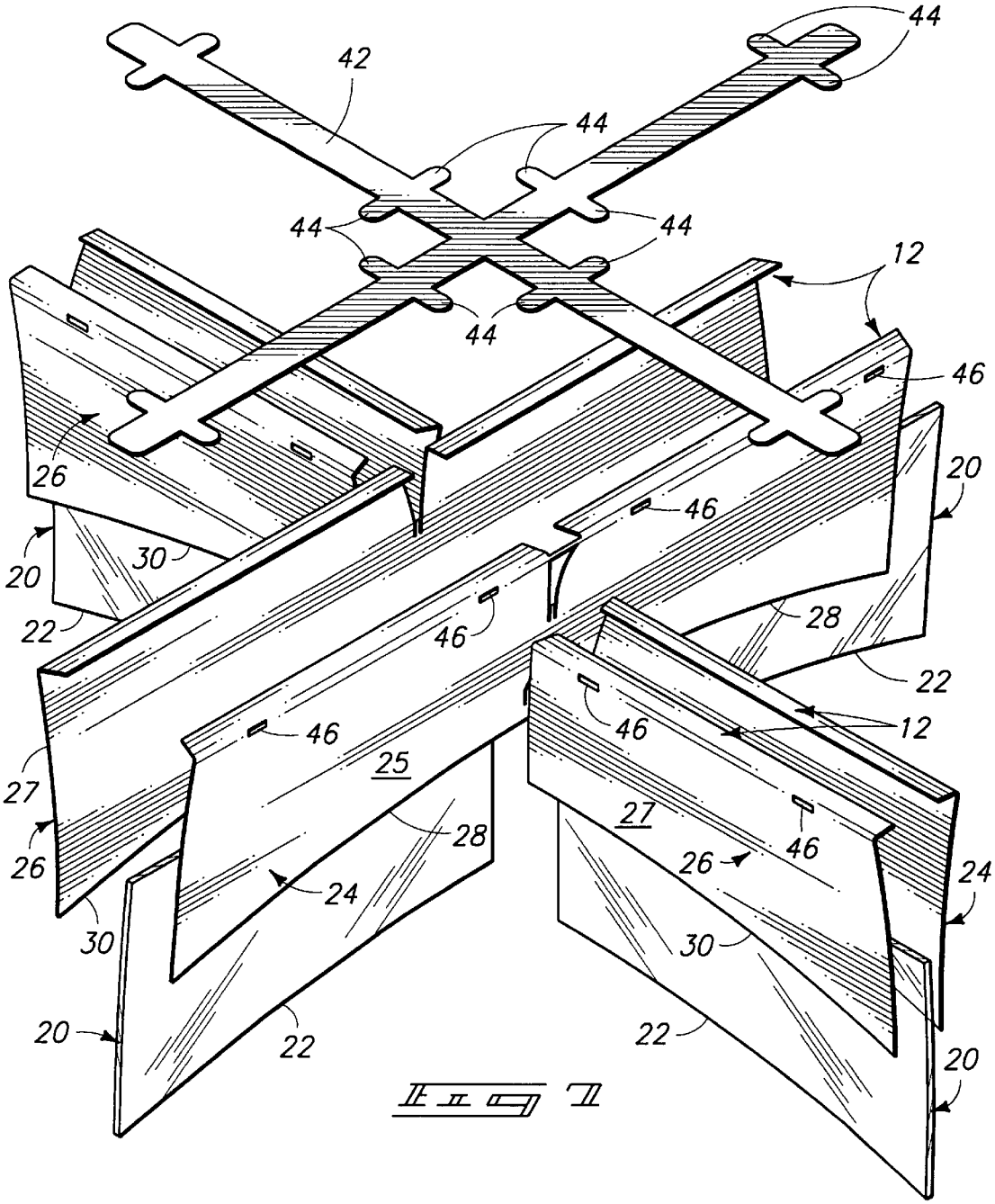
FIG. 7 is an exploded view of the elements in the embodiment shown in FIG. 6.

The decorative member 20 may be opaque but is preferably transparent or translucent and constructed of an appropriate material such as plastic, though glass may be used in some embodiments. Member 20 may be formed from flat plate material in embodiments such as illustrated in FIG. 7, using conventional cutting or forming equipment or be molded or cast in any appropriate configuration for assembly with one or more louver bodies 12 in a light fixture. In the examples illustrated, a cruciform configuration is shown as a complete louver assembly (FIG. 5) or as a part of a geometric grid configuration common to lighting louver construction. However, the present louver elements 10 including the decorative members 20 could be made in other geometric shapes (such as a radial spoke array) or possibly even non-geometric configurations.

Referring now in greater detail to FIGS. 1–4, the illustrated example includes a louver body 12 that is formed of two sheets of opaque specular material with interlocking tabs 32 joined at the top end 16 of the louver body. The oppositely facing side surfaces 14 of the exemplary sheets are specular and formed in conventional parabolic curvatures, converging from the top end 16 to the bottom end 18.

Figure 1:
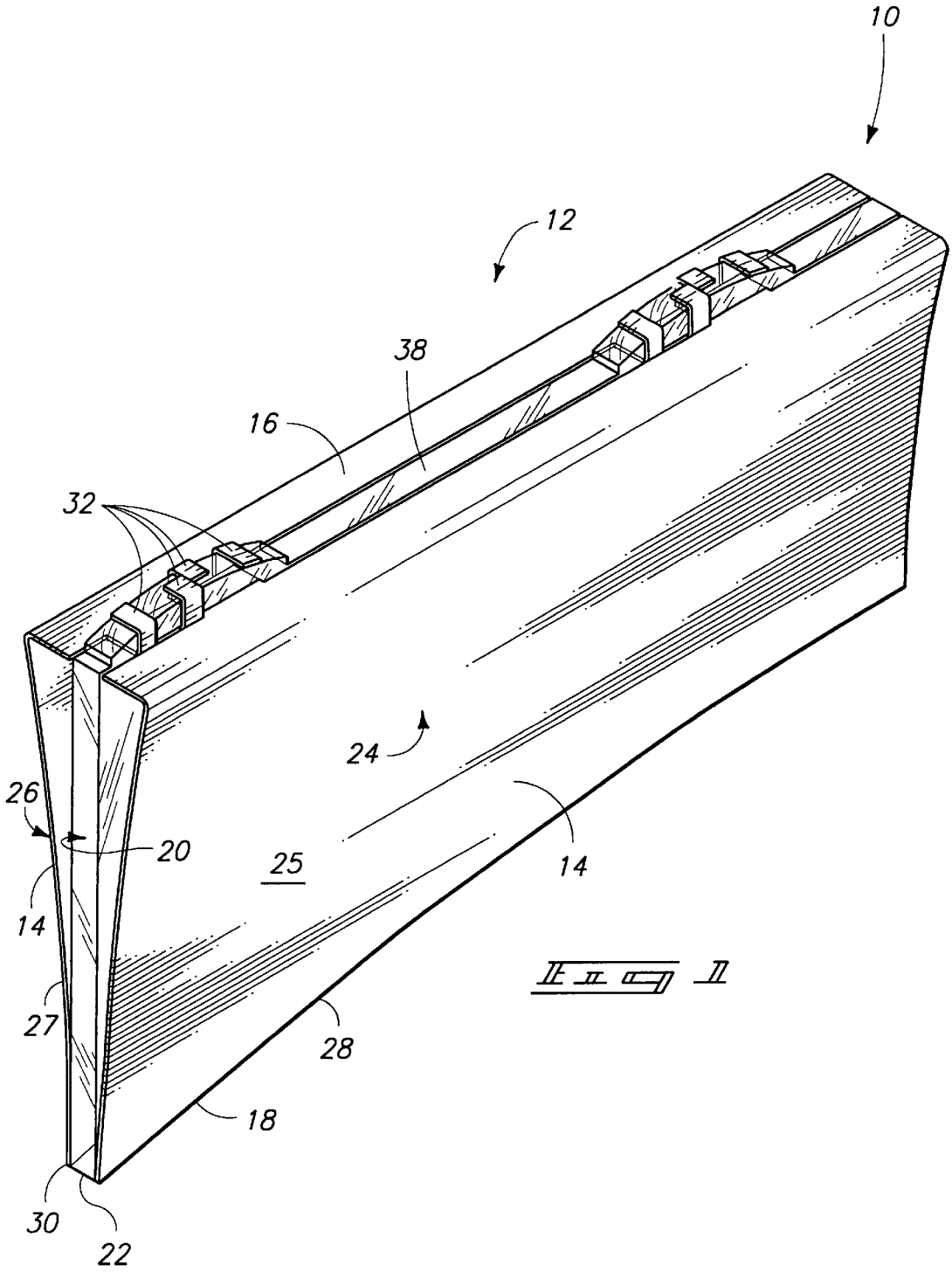
FIG. 1 is a perspective view of a first preferred example of the present decorative lighting louver element.
Figure 2:
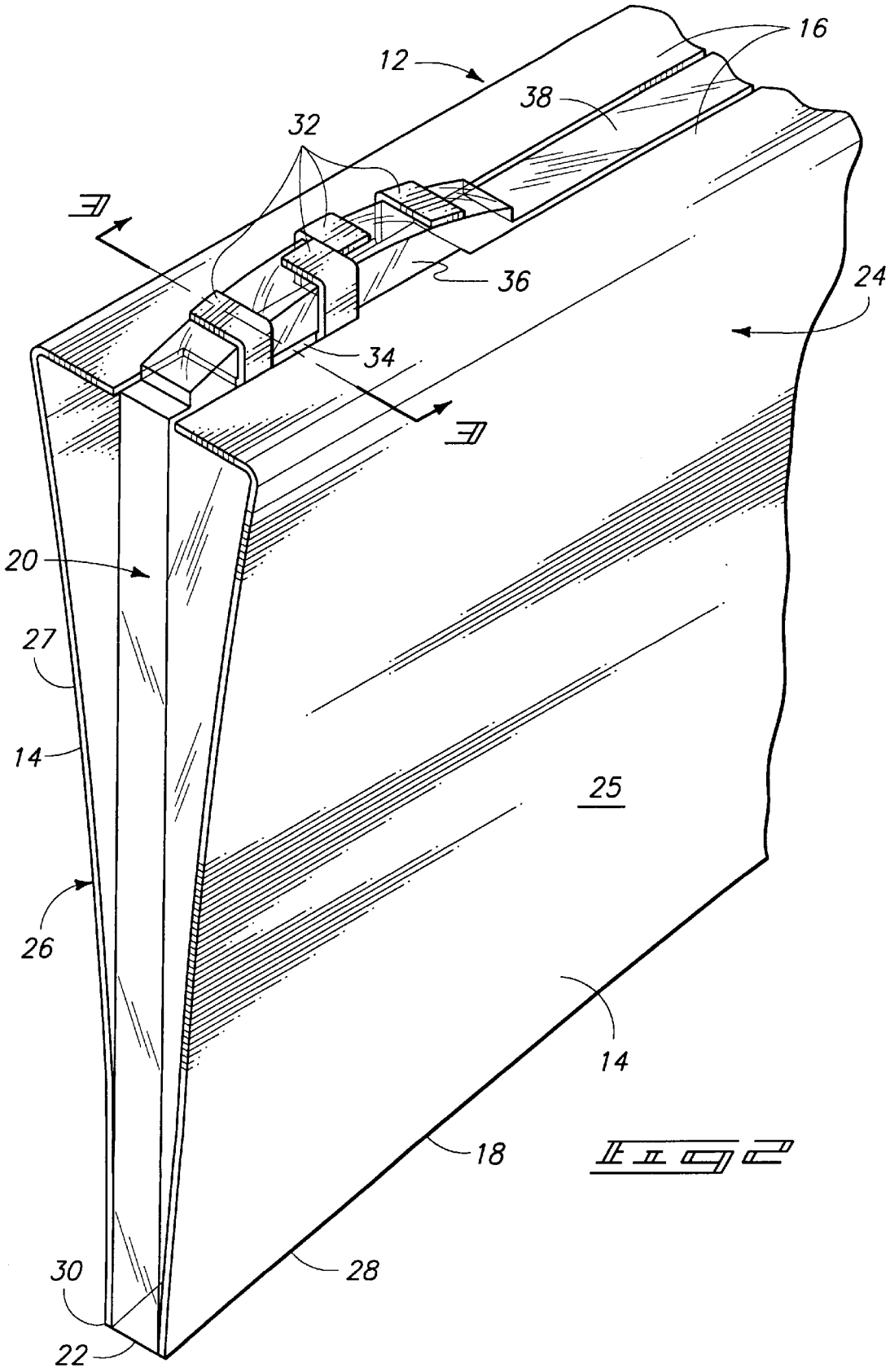
FIG. 2 is an enlarged detail view of the embodiment shown in FIG. 1.
Figure 3:
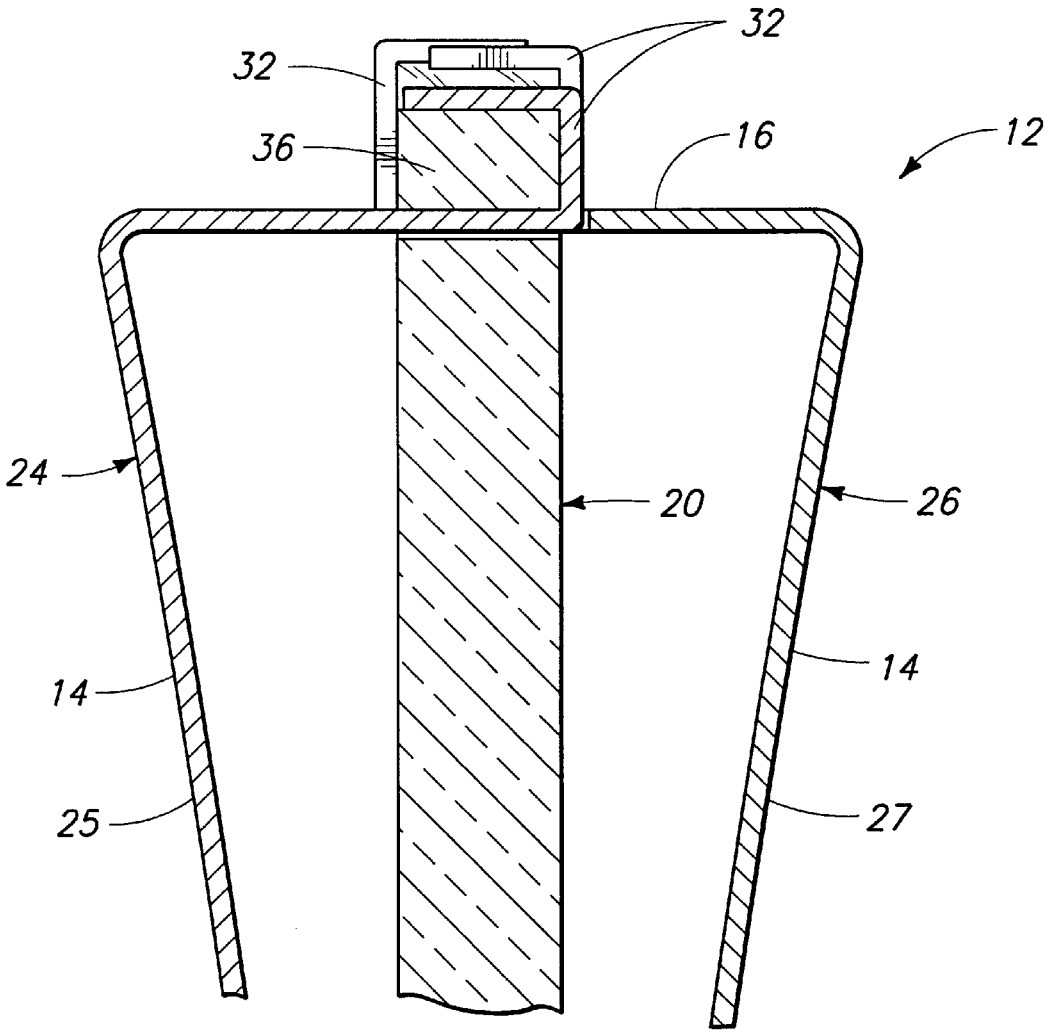
FIG. 3 is an enlarged sectional view taken substantially along line 3—3 in FIG. 2.

The tabs 32 interlock within respective slots 34 formed in ears 36 on the decorative member 20. FIGS. 2–4 best show this interfitting relationship. The tabs 32, which are preferably integral with the sheets 24, 26 are initially straight and disposed along the respective sheets in alternate longitudinal positions as shown in FIG. 4. They are slidably received within the slots 34, and are bent up and over the ears 36 to lock the three components (the two sheets 24, 26 and decorative member 20) together in the configuration shown in FIGS. 1 and 2.

The configuration shown in FIGS. 1 and 2 can be used to expose a top edge 38 of decorative member 20 with the bottom member edge 22 exposed below. Thus, if the member 20 is light conductive between the top and bottom member edges 38, 22, light exposed to the top member edge 38 will be transmitted through the decorative member 20 to emit from the bottom member edge 22. This arrangement can be used to produce an interesting visual effect, with the bottom end 18 of the louver element 10 being illuminated instead of appearing as a dark line.

Light transmission may be occur in a manner similar to fiber optic light transmission, with the side surfaces of the decorative member 20 being are reflective and the end edges 38, 22 of the member being light transmissive so light from above the element will be readily transmitted through and out the bottom member edge 22.

Figure 6:
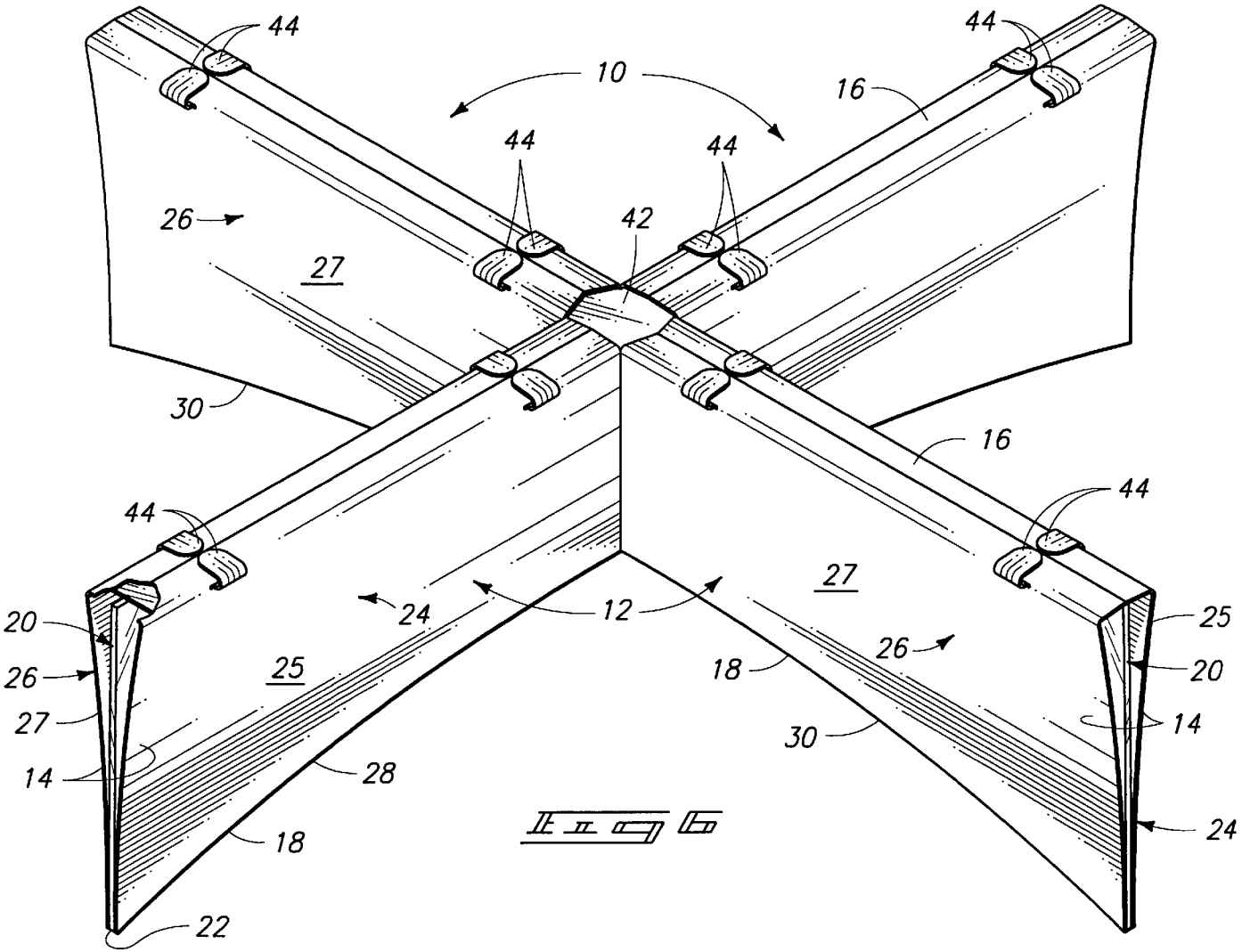
FIG. 6 is a perspective view of an assembly of the present decorative lighting louver elements in another embodiment.

Alternatively, the element 10 may be constructed with the top edge 38 of the decorative member 20 covered by a top flange member 42. This preferred form of the louver body 12 is exemplified by FIGS. 6 and 7. As shown, the flange member 42 may be provided with tabs 44 that fit through corresponding slots 46 (FIG. 7) formed in the sheets 24, 26. The sheets 24, 26 are bent and fitted together over the flange member 42 to form a substantially horizontal top surface on the element 10. The slots 46 are formed substantially at the bend surfaces to accept the flange tabs 44. The tabs 44 may be folded over onto the horizontal top surface to lock the sheets 24, 26 together as shown by FIG. 6, sandwiching the decorative member 20.

It is noted that the flange member 42 may be used to shape the pattern or configuration for the resulting lighting fixture. For example, the cruciform flange configuration shown in FIG. 7, when attached to appropriate louver sheets, will result in the cruciform configuration of the assembly shown in FIG. 6. Of course the pattern can be extended to produce a grid, or be made in other shapes as well.

Figure 8:
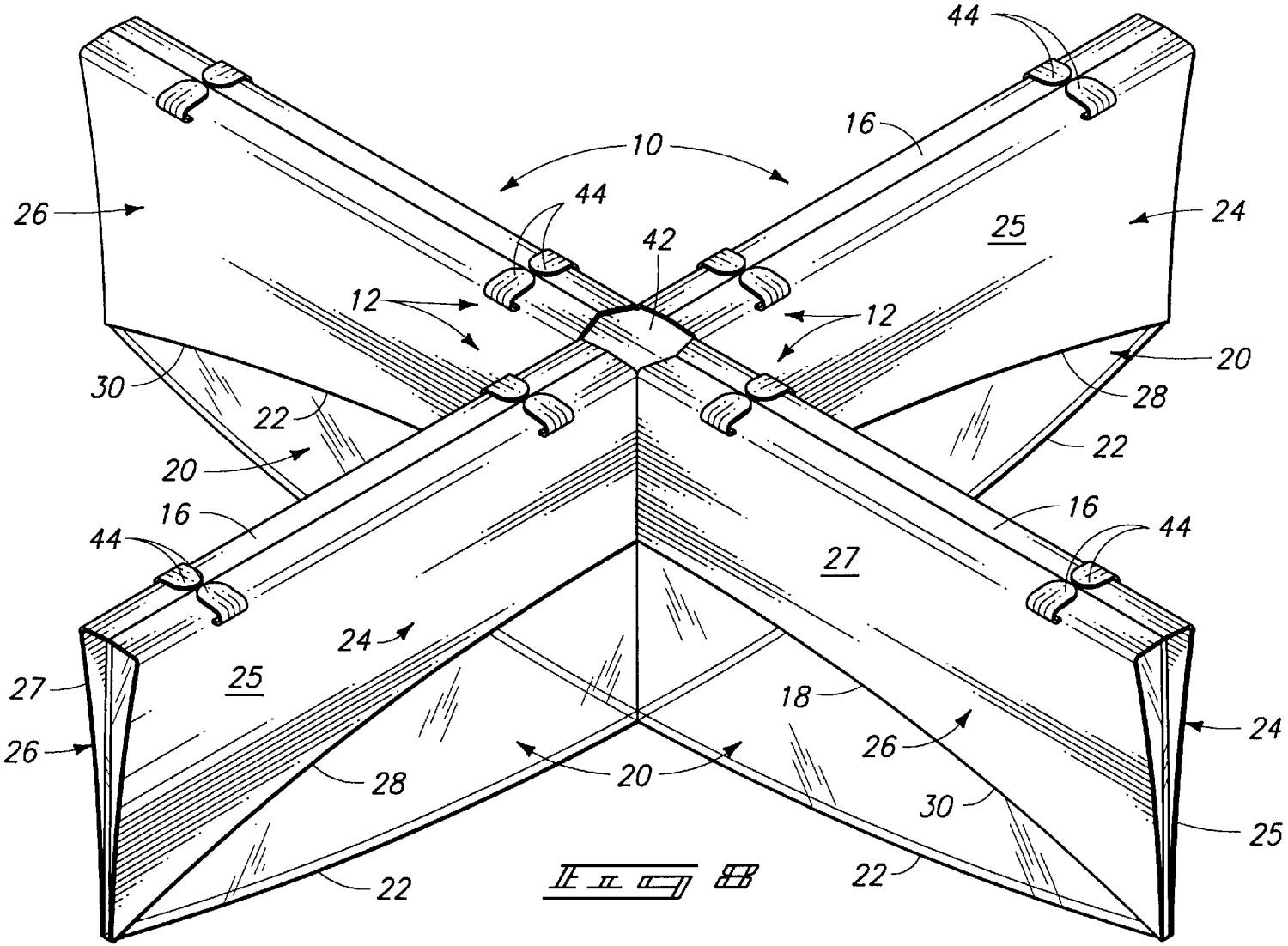
Figure 9:
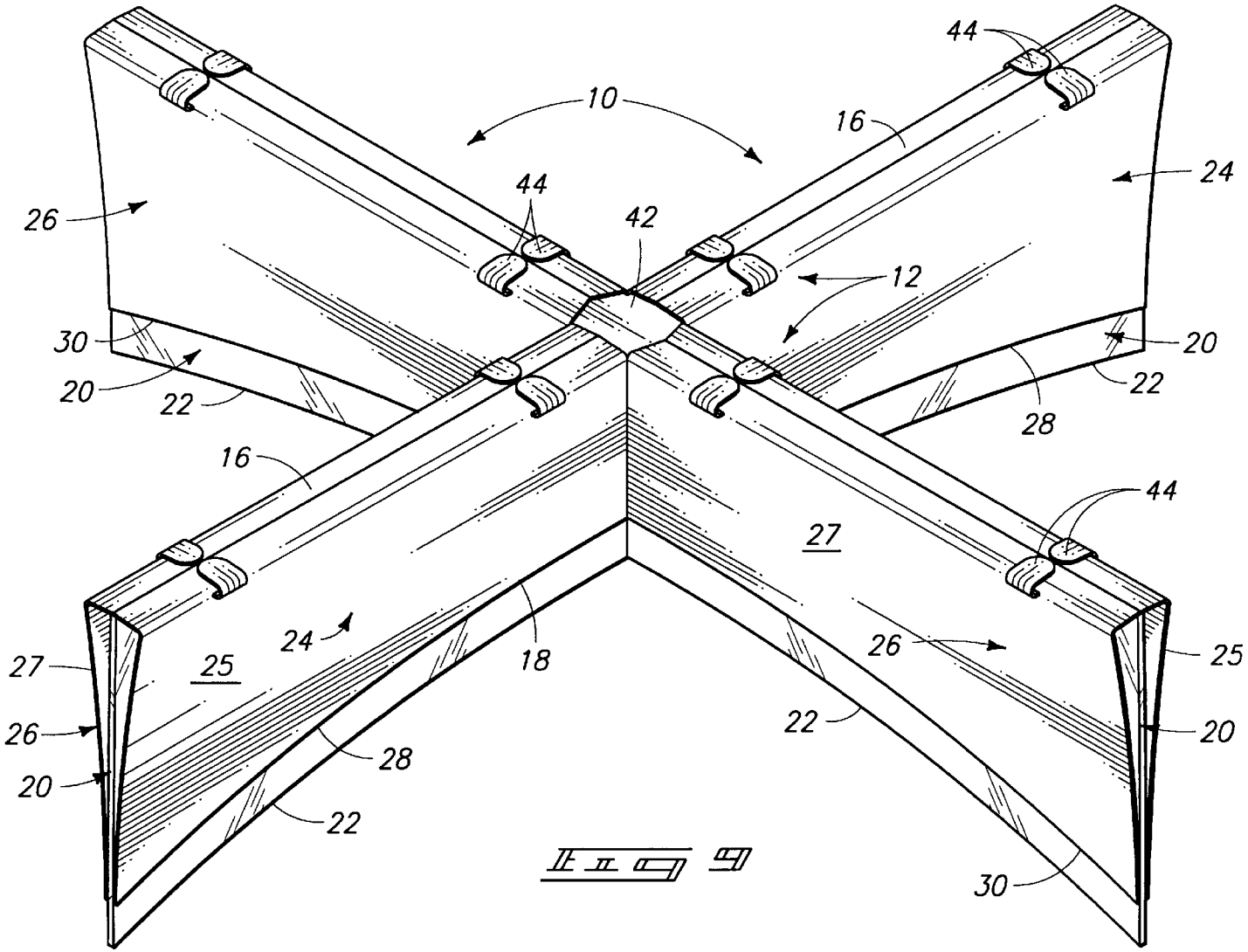
Figure 11:
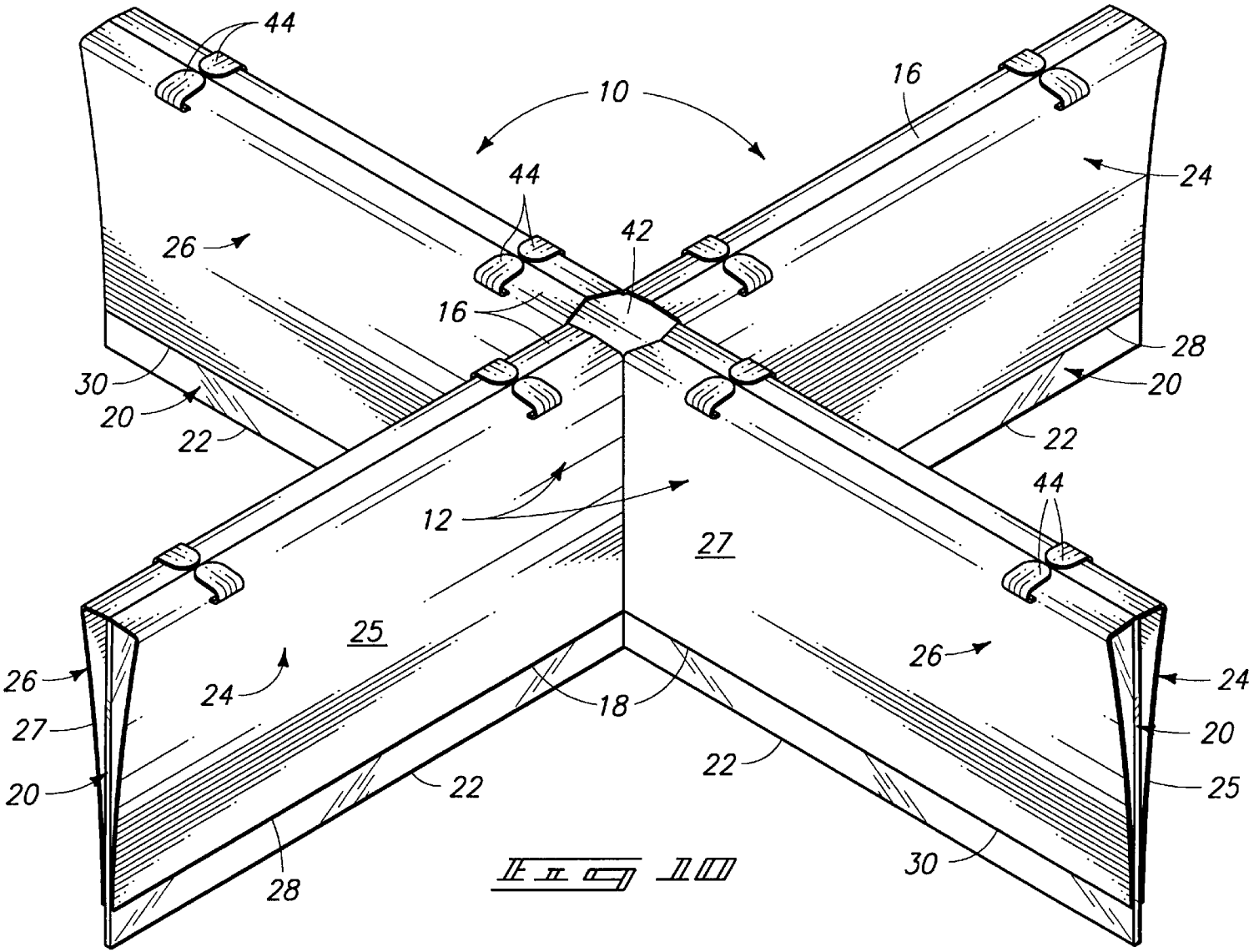
Figure 11:
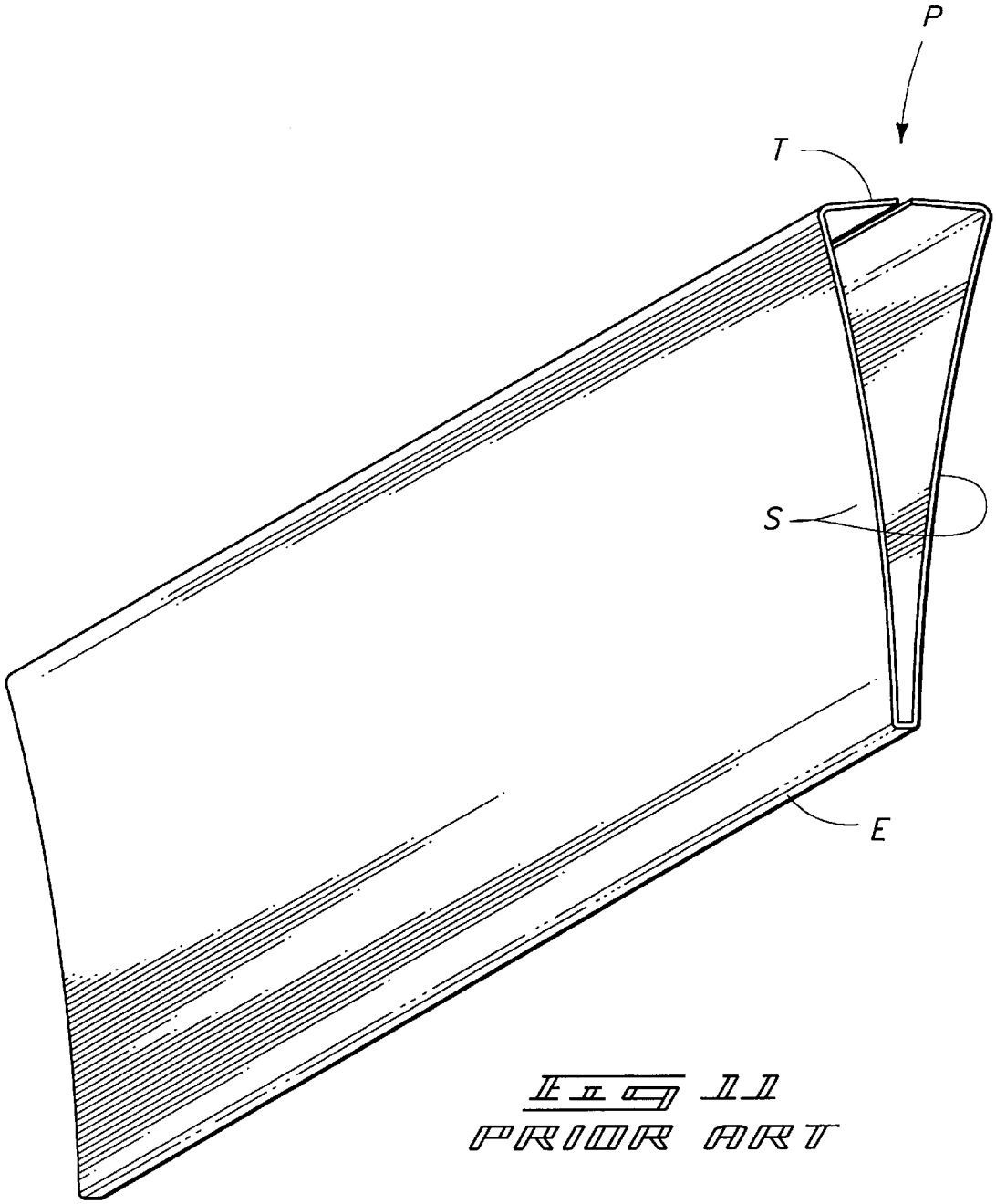
FIG 11 PRIOR ART

FIGS. 8–10 are included to demonstrate examples of different configurations of the louver element that may be achieved simply by altering the shape of the bottom member edge 22, or the bottom edges 28, 30 of the sheets 24, 26. As may be noted, the edges 22 and 28, 30 may be parallel (FIG. 10) and adjacent one another, or in juxtaposition as shown in FIGS. 1 and 2. Alternatively, the edges 22, and 28, 30 may not be parallel (note FIGS. 7). Further, as demonstrated by FIG. 8, the edges 22, and 28, 30 may have similar but offset shapes. In fact, an almost infinite variety of other bottom edge shapes are possible. This gives the lighting designer much more flexibility to design interesting and attractive lighting fixtures without sacrificing the known advantages of parabolic lighting louvers.

Figure 5:
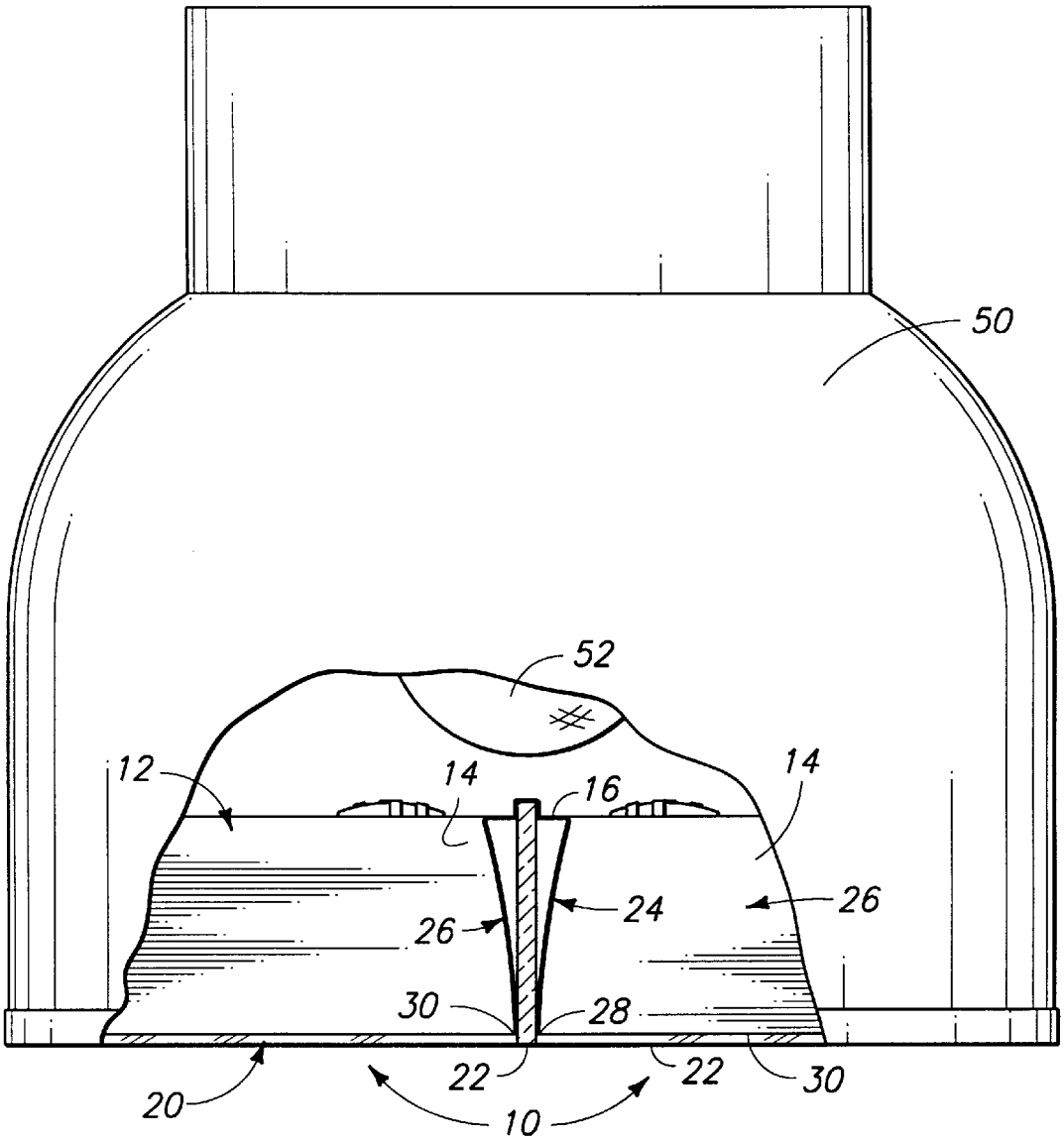
FIG. 5 is an elevational view illustrating application of an assembly of the present louver elements in a "high hat" recessed light fixture.

FIG. 5 indicates a operation of an exemplary configuration of the present decorative louver element 10, shaped in a cruciform configuration and positioned within a "high hat" light fixture 50. Light emitting from a source such as a tube or bulb 52 will be reflected downwardly from the interior confines of the light fixture 50, and be further controlled according to the parabolic configuration of the louver side surfaces 14. The downwardly exposed bottom surface 22 of the sandwiched decorative member 12 and the bottom edges 28, 30 of the louver body will be viable from below, but will not substantially affect the utilitarian aspects of the parabolic specular surfaces of the louver bodies.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A decorative lighting louver element, comprising:

a louver body having opposed side surfaces;

the louver body further including a top end and a bottom end; and a decorative member sandwiched between the opposed side surfaces and including an edge that is visually exposed adjacent the bottom end of the louver body.

2. The decorative lighting louver element of claim 1, wherein the louver body is formed of two sheets of material joined at the top end of the louver body.

3. The decorative lighting louver element of claim 1, wherein the louver body is formed of two sheets of material joined at the top end and having juxtaposed bottom edges biased toward one another and defining the bottom end.

4. The decorative lighting louver element of claim 1, wherein the louver body is formed of two sheets of material joined at the top end of the louver body; and wherein the decorative member is joined to the two sheets at the top end of the louver body.

5. The decorative lighting louver element of claim 1, wherein the louver body is formed of two sheets of material with interlocking tabs joined at the top end of the louver body; and wherein the decorative member includes an ear joined with the interlocking tabs.

6. The decorative lighting louver element of claim 1, wherein the opposed side surfaces are formed of specular aluminum.

7. The decorative lighting louver element of claim 1, wherein the opposed side surfaces include oppositely facing parabolic surface configurations.

8. The decorative lighting louver element of claim 1, wherein the decorative member projects outwardly of the bottom end of the louver body.

9. The decorative lighting louver element of claim 1, wherein the decorative member is transparent.

10. The decorative lighting louver element of claim 1, wherein the decorative member includes a top member edge and a bottom member edge and is light conductive between the top and bottom member edges such that light exposed to the top member edge will be transmitted through the decorative member to emit from the bottom member edge; and wherein the top member edge of the decorative member is exposed at the top end of the louver body.

11. The decorative lighting louver element of claim 1, wherein the decorative member is transparent and extends from the top to the bottom end of the louver body.

12. The decorative lighting louver element of claim 1, wherein the decorative member extends from the top to the bottom end of the louver body.

13. The decorative lighting louver element of claim 1, wherein the decorative member includes a bottom member edge that projects outwardly of the bottom end of the louver body and that is substantially parallel to the bottom end of the louver body.

14. The decorative lighting louver element of claim 1, wherein the decorative member includes a bottom member edge that projects outwardly of the bottom end of the louver body and that is not parallel to the bottom end of the louver body.

15. A decorative lighting louver element, comprising:

a louver body formed of opposed sheets, each having an outwardly facing surface;

the louver body further including a top end where the opposed sheets are joined together and a bottom end; and a decorative member sandwiched between the opposed sheets and including an bottom member edge that is visually exposed adjacent the bottom end of the louver body.

16. The decorative lighting louver element of claim 15, wherein the bottom member edge projects outwardly of the bottom end of the louver body and is not parallel to the bottom end of the louver body.

17. The decorative lighting louver element of claim 15, wherein the decorative member includes a bottom member edge that projects outwardly of the bottom end of the louver body and is substantially parallel to the bottom end of the louver body.

18. The decorative lighting louver element of claim 15, wherein the two sheets are formed of specular aluminum and include interlocking tabs joined at the top end of the louver body.

19. The decorative lighting louver element of claim 15, wherein the two sheets are joined by interlocking tabs at the top end of the louver body.

20. A decorative lighting louver element, comprising:

a louver body having opposed outwardly facing specular parabolic surfaces;

the louver body further including a top end and a bottom end defined by bottom edges of the specular parabolic surfaces; and a decorative member sandwiched between the specular parabolic surfaces and including a bottom member edge that is visually exposed between the specular parabolic surfaces adjacent the bottom edges.

* * * * *